United States Patent [19]

Pasternack

[11] 4,292,967

[45] Oct. 6, 1981

[54] RESPIRATOR HAVING OXYGEN DELIVERING CHEMICAL CARTRIDGE

[75] Inventor: Adalbert Pasternack, Bad Schwartau, Fed. Rep. of Germany

[73] Assignee: Drägerwerk Aktiengesellschaft, Fed. Rep. of Germany

[21] Appl. No.: 103,491

[22] Filed: Dec. 14, 1979

[30] Foreign Application Priority Data

Dec. 27, 1978 [DE] Fed. Rep. of Germany ..... 2856349

[51] Int. Cl.[3] ..... A62B 7/08

[52] U.S. Cl. ..... 128/202.26; 422/119; 422/126; 422/123; 55/DIG. 33; 55/DIG. 34; 55/274; 55/270; 116/200; 73/29; 73/52

[58] Field of Search ..... 128/202.26, 202.22, 128/205.23, 205.28; 73/29, 52; 116/206, 205, 200; 55/270, DIG. 34, DIG. 33, 274; 44/3 B; 422/119, 120, 126, 123, 122

[56] References Cited

U.S. PATENT DOCUMENTS 2,579,477 12/1951 Dauphine ..... 55/270
3,143,997 8/1964 Norberg et al. ..... 116/200
4,154,236 5/1979 Eckstein et al. ..... 128/202.26

FOREIGN PATENT DOCUMENTS 207745 11/1968 U.S.S.R. ..... 128/202.26

*Primary Examiner*—Henry J. Recla
*Attorney, Agent, or Firm*—McGlew and Tuttle

[57] ABSTRACT

A respirator, comprises, a housing having a wall with a sealable opening which is advantageously located in a cover of the housing. A chemical cartridge is disposed in the housing and it has a material capable of generating oxygen upon being started. A breathing tube is connected into the cartridge along with a breathing bag so that a person's respiratory gases may be directed into the cartridge to the bag and then back through the material of the cartridge which also advantageously retains the $CO_2$ and enriches the respiratory gas with oxygen. A first starter is associated with the cartridge for starting the material so that it generates oxygen and a second control element is disposed in the container adjacent the sealable wall and it has a starting material therein which may be actuated to generate oxygen so as to provide an indication of whether the oxygen-generating material is operating properly and can perform its function.

4 Claims, 1 Drawing Figure

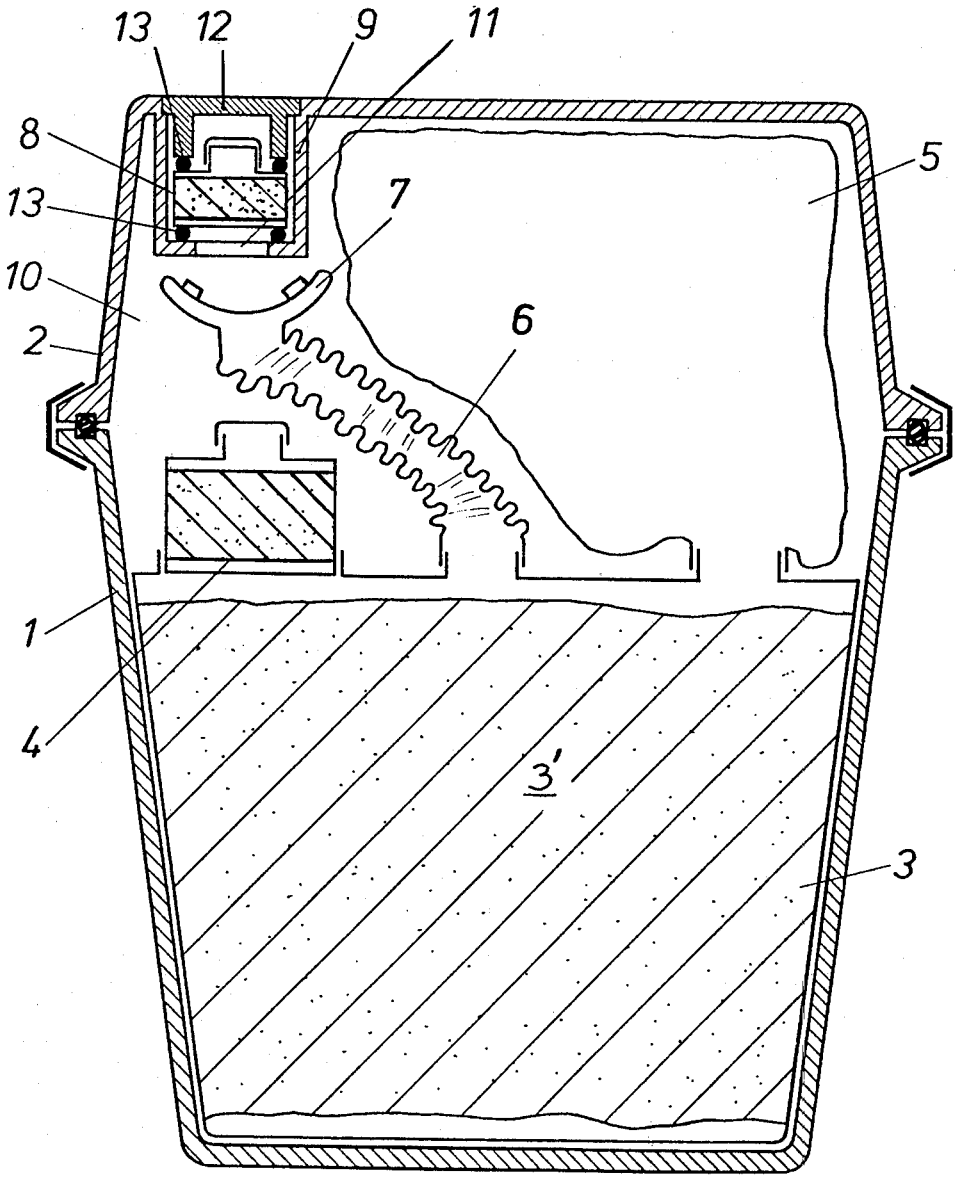
13
12
9
11
8
13
7
5
10
2
6
1
4
3'
3

RESPIRATOR HAVING OXYGEN DELIVERING CHEMICAL CARTRIDGE

FIELD AND BACKGROUND OF THE INVENTION

This invention relates to respirators in general and, in particular, to a new and useful respirator having an oxygen-delivering chemical cartridge and including means for determining whether the material of the chemical cartridge is still effective.

Respirators having an oxygen-delivering chemical cartridge are equipped with a gas-tight container. The container, which is usually in the form of a tank is necessary because the chemical cartridge, and particularly, the quick-starter contained therein, which ensures the production of oxygen in the first minutes of ventilation, are sensitive to moisture. The moisture would make the quick-starter and the oxygen-delivering cartridge unusable and, if provided, the $CO_2$-binding cartridge would also be unusable. Accordingly, it must be possible to determine the operable state at any given time.

Respirators are known which are equipped with filter materials which absorb water vapor from the surrounding air, and thus become unusable. Such filter materials, such as, Hopkalite, for example, are provided in filters which act against carbon dioxide. Other apparatus may contain carbon dioxide-binding cartridges, which, when filled with alkali hydroxide, also readily absorb water vapor. In order to prevent the change of the filter materials caused by water vapor, the respirators which are filled with these filter materials are arranged in special gas-tight containers. The tight seal of these respirators is determined by weight checks. Constancy of weight is an indication that the filter material is alright. In order to simplify the weight check, the apparatus can have a standard weight.

The operation of the respirators according to the invention cannot be determined by means of a weight check. Entering moisture leads to a chemical reaction, with the production of an equivalent amount of oxygen, which in turn, leads to constancy of weight (See German Pat. No. 1,022,095).

Another known respirator with water vapor-sensitive filling material has an inner container protecting at least the filling material, and an outer container surrounding the entire apparatus including the inner container. A drying agent is arranged in the space between the inner and outer container. This has the effect that no moisture, or hardly any moisture can accumulate in this space, so that hardly any moisture can diffuse into the inner container in the direction of the filling materials. The drying agent, e.g., blue gel, can show a complete or partial color change when a certain amount of moisture has been absorbed. This makes it possible to see, on the basis of the color of the drying agent, whether the respirator is still in good condition in respect to the penetration of moisture, or if it is already in danger.

The container of this respirator is a complicated double container. The drying agent which also acts as a moisture indicator keeps the space between the containers dry. It becomes moist after the outer container begins to leak. The moisture absorption of the filling material is determined by the tightness of the inner container. A simultaneous leakage of the outer container makes a dangerous moisture absorption of the filling material very likely. This amount of moisture missing in the moisture indicator then leads to a lower reading, which is then responsible for an incorrect evaluation of the operability of the device (See German Pat. No. 21 63 125).

A known device for indicating the tightness of a container for objects to be stored in a vacuum, e.g., respirator consists of a siphon connected with the interior of the container stored in a vacuum, which is arranged in a chamber sealed from the surrounding atmosphere. A ball is arranged in the space between the movable end wall of the siphon and the opposite chamber wall, which moves when the container is evacuated, that is, intact. When the container leaks and the vacuum is thus reduced, the siphon expands axially, thus reducing the interval. When the interval attains a clear height which corresponds to the diameter of the ball, the latter is immobilized. Its mobility is therefore an indication that the container is intact.

This known indicator can only be used in apparatus with a vacuum container. Beyond that, it requires a certain space for the movable siphon (German Patent Application No. P 28 24 175.0-27).

SUMMARY OF THE INVENTION

The present invention provides a device with a control element for respirators with an oxygen-delivering chemical cartridge, which permits a reliable determination of the operability of the chemical cartridge and its quick-starter.

In accordance with the invention, a respirator comprises a housing which has a wall, such as a cover with a sealable opening, which contains a control element in a subchamber of the cover which is accessible from the outside by removal of the seal. The container also contains a material capable of generating oxygen upon being started and includes a starter associated therewith for effecting the starting of the generation of the oxygen. A control element disposed in the housing also contains a starting material which may be actuated to generate oxygen so as to provide an indication that the filling materials of the oxygen-generating cartridge will still perform their function.

Among other advantages achieved by the present invention is that it makes it possible to clearly determine the condition of the filling material by means of the control element, without opening the container. If a check of the control element shows that its filling material still generates the required amount of oxygen, it is ensured that the filling materials of the oxygen-delivering and $CO_2$-binding chemical cartridge can still perform their functions.

The arrangement of the control element in the mount represents a simple constructional solution. Its removal, after the seal has been removed, is simple. The mount is designed so that it establishes direct gas contact with the interior of the container and thus also with the filling materials of the chemical cartridge. Moisture penetrating through any leaks in the container admit the control element and the chemical cartridge filling to the same extent. An additional safety factor regarding the decision by the control element results from the fact that its filling material has a far greater moisture affinity to the filling material for oxygen-delivery and $CO_2$-absorption within the chemical cartridge.

By providing several control elements in the mount, the determination of the operability can be repeated as often as there are control elements. This applies particularly to respirators stored for long periods of time for use as gas masks.

Accordingly, an object of the invention is to provide a respirator which has a chemical cartridge therein with a material capable of generating oxygen upon being started and which includes a starter associated therewith and a control element which may be actuated so as to determine whether the material which generates oxygen is capable of operation.

A further object of the invention is to provide a respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a transverse sectional view of a respirator constructed in accordance with the present invention.

DESCRIPTION OF THE PREFERRED EMBODIMENT

Referring to the drawing in particular, the invention embodied therein, comprises, a housing which is madeup of a bottom part 1 and a cover 2 which closes bottom part 1. A cartridge 3 is disposed in the housing bottom part 1 and it contains a material 3' which comprises a chemical having a characteristic that it will deliver oxygen upon being started and it will also retain $CO_2$ of the respiratory gases. A quick-starter 4 is associated with the cartridge as an integral part thereof and it may be started to effect the actuation of the chemical 3' and the generation of the oxygen.

The cartridge is connected to a breathing bag 5 and respiratory gases are directed through a mouthpiece 7 which may be employed by the user through a breathing tube into the chemical 3' and then the breathing bag 5. During the circulation of the gases through the chemical 3' and the breathing bag 5, $CO_2$ is retained by the chemical and oxygen is added to the respiratory gases. In accordance with the invention, the cover 2 is provided with a wall portion forming a mount 9 for a control element 8 which is accessible from the exterior of the container by the removal of a seal 12 and associated gaskets 13. Control element 8 which is disposed in mount 9 is in direct gas contact with the interior 10 of the container through an opening 11 in the bottom of the mount 9. One or more such control elements constituting control element means may be provided in the container and they may be removed and replaced after removal of the associated seal 12.

The operability of the chemical cartridge 3 and of its associated quick-starter 4 is determined by checking control element 8 which is made of the same material as the quick-starter 4. The control element 8 substantially comprises a smaller version of the starter 4 and it is started in the same manner as the quick-starter 4 in a well-known manner. When control element 8 is started, it generates oxygen and from the heat effect which is produced thereby, it is possible to draw a conclusion of the operability of the chemical cartridge 3, having its associated quick-starter 4. This monitoring effect is enhanced by the fact that the material of control element 8 has by far a greater moisture affinity as compared to the filling materials for the chemical 3'.

In an embodiment where the control means 8 comprises a plurality of control elements, the operability of the chemical cartridges 3 and its associated quick-starter 4 can be repeated corresponding to the number of control elements which are employed.

While a specific embodiment of the invention has been shown and described in detail to illustrate the application of the principles of the invention, it will be understood that the invention may be embodied otherwise without departing from such principles.

What is claimed is:

1. A respirator, comprising, a housing having a wall with a sealable opening, a chemical cartridge in said housing spaced from said sealable opening having a material capable of generating oxygen upon being started, breathing tube means connected into said cartridge for the circulation of respiratory gases therethrough, a first starter associated with said cartridge and located in said housing for starting the material so that it will generate oxygen, and a control element disposed in said housing adjacent to said sealable opening in said wall so as to be accessible from the outside of the housing upon the opening of the sealable opening, said control element having a starting material therein which is spaced from said cartridge and which may be actuated to generate oxygen so as to provide an indication of the operability of said chemical cartridge while not starting the material of said cartridge.

2. A respirator, as claimed in claim 1, wherein said housing includes a mounting therein which is open to the interior and is adjacent said sealable opening said control element being disposed in said mounting, and said sealable opening including gasket means sealing said control element.

3. A respirator, as claimed in claim 1, wherein said control element comprises several individual control members.

4. A respirator, as claimed in claim 1, wherein said housing includes a bottom portion containing said cartridge and a cover closing said bottom portion, said breathing tube means including a breathing tube connected to said cartridge and having a mouth piece and a breathing bag connected to said cartridge at a spaced location from said breathing tube so that the respiratory gases may be circulated from said breathing tube through the material of the cartridge to said breathing bag, and a cover closing the top of said housing having a chamber defined therein adjacent said sealable opening containing said control element, said chamber communicating with the interior of said housing.

* * * * *